United States Patent [19]

Yoshimura et al.

[11] Patent Number: 4,886,613

[45] Date of Patent: Dec. 12, 1989

[54] TRACTION FLUID

[75] Inventors: Narihiko Yoshimura; Yasuji Komatsu; Hirotaka Tomizawa, all of Saitama, Japan

[73] Assignee: TOA Nenryo Kogyo, K.K., Tokyo, Japan

[21] Appl. No.: 76,708

[22] Filed: Jul. 23, 1987

[51] Int. Cl.[4] ..... C09K 5/00

[52] U.S. Cl. ..... 252/79; 252/56 D; 252/56 R; 252/56 S; 560/1; 560/193; 560/204

[58] Field of Search ..... 560/1, 193; 252/56 R, 252/79, 56 S, 56 D

[56] References Cited

U.S. PATENT DOCUMENTS

| | | | |
|---|---|---|---|
| 2,807,638 | 9/1957 | Morris et al. | 560/1 |
| 4,343,652 | 8/1982 | Allart | 106/21 |
| 4,464,277 | 8/1984 | Cousineau | 252/56 |
| 4,507,408 | 3/1985 | Torbus et al. | 523/143 |
| 4,514,190 | 4/1985 | Cousineau et al. | 44/70 |
| 4,645,855 | 2/1987 | Reuvers et al. | 560/204 |

FOREIGN PATENT DOCUMENTS 786950 11/1957 United Kingdom .

OTHER PUBLICATIONS

*Chemical Abstracts,* vol. 75, No. 19, 117945b, (1971). Acylation of Glycerol, Ismailov, A. G., Salimova, 1971, No. 2, 49–54(Russ.), from Ref. Ah., Khim, 1972, Abstr. No. 4Zh180.

*Primary Examiner*—Werren B. Lone
*Assistant Examiner*—Vera C. Clarke
*Attorney, Agent, or Firm*—M. B. Kapustij

[57] ABSTRACT

A traction fluid comprising a diester or its derivative represented by the formula:

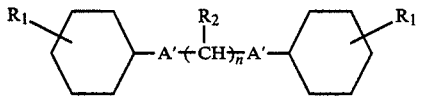

wherein A′ is an ester linkage, n is an integer of 1 to 10, $R_1$ is independently selected from hydrogen and $C_1$ to $C_8$ alkyl groups, and $R_2$ is the same or different and is selected from hydrogen and $C_1$ to $C_3$ alkyl groups.

10 Claims, No Drawings

TRACTION FLUID

FIELD OF THE INVENTION

This invention relates to a traction fluid. More particularly, the present invention is concerned with a rings or its derivative as the base.

BACKGROUND OF THE INVENTION

Traction drive power transmissions, which transmit power to a driven part through a traction drive mechanism, have attracted attention in the field of automobiles and industrial machinery, and in recent years research and development therein has advanced. The traction drive mechanism is a power transmitting mechanism using a rolling friction. Unlike conventional drive mechanisms it does not use any gears, which enables a reduction in vibration and noise as well as a smooth speed change in high-speed rotation. An important goal in the automobile industry is improvement in the fuel economy of automobiles. It has been suggested that if the traction drive is applied to the transmission of automobiles to convert the transmission to a continuous variable-speed transmission, the fuel consumption can be reduced by 20% or more compared to conventional transmission systems since the drive can always be in the optimum speed ratio. Recent studies have resulted in the development of materials having high fatigue resistance and in the theoretical analysis of traction mechanisms. Regarding the traction fluid, the correlation of traction coefficients is gradually being understood on a level of the molecular structure of the components. The term "traction coefficient" as used herein is defined as the ratio of the tractional force caused by slipping at the contact points between rotators which are in contact with each other in a power transmission of the rolling friction type to the normal load.

The traction fluid is required to be comprised of a lubricating oil having a high traction coefficient. It is known that a traction fluid possessing a molecular structure having a naphthene ring exhibits a high performance. "Santotrack ©" manufactured by the Monsanto Chemical Company is widely known as a commercially available traction fluid. Japanese Patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated (α-methyl)styrene polymer, hydrindane compound or the like has a high traction coefficient. Further, Japanese Patent Laid Open No. 191797/1984 discloses a traction fluid containing an ester compound having a naphthene ring. It teaches that an ester obtained by the hydrogenation of the aromatic nucleus of dicyclohexyl cyclohexanedicarboxylate or dicyclohexyl phthalate is preferable as the traction fluid.

As mentioned above, in recent years there has been progress in the development of continuous variable-speed transmissions. The higher the traction coefficient of the traction fluid, the larger the allowable transmission force in the device. This allows a reduction in the size of the device with a corresponding reduction in exhaust gas, thereby reducing environmental pollution. Therefore, there is a demand for a fluid having a traction coefficient as high as possible. However, even the use of a traction fluid which exhibits the highest performance of all the currently commercially available fluids in such a traction drive device results in unsatisfactory performance as regards the traction coefficient, and is also costly. The traction fluid which has been proposed in Japanese Patent Publication No. 35763/1971 contains Santotrack or its analogue as a component and, therefore, is also unsatisfactory with respect to performance and economics.

SUMMARY OF THE INVENTION

A traction fluid comprising a diesteric compound or its derivative represented by the general formula

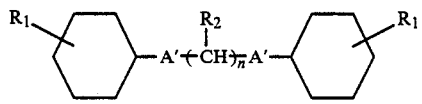

wherein A' indicates an ester linkage of —COO— or —OOC—, n is a number to 10, $R_1$ is the same or different and is selected from hydrogen and alkyl groups with 1 to 8 carbons, and $R_2$ is the same or different and is selected from hydrogen and alkyl groups containing from 1 to 3 carbons.

DETAILED DESCRIPTION OF THE INVENTION

The present inventors have made extensive and intensive studies with a view to developing a traction fluid which not only exhibits a high traction coefficient but is also economical. As a result, the present inventors have found that the utilization of a diester or its derivative in which two cyclohexyl rings are connected through a linear chain hydrocarbon can provide an economical high-performance base oil fluid. The present invention is based on this finding.

According to the present invention there is provided a traction fluid comprising a diester or its derivative represented by the following general formula

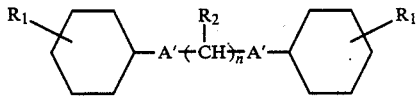

wherein A' is an ester linkage of —COO— or —OOC—, n is an integer of 1 to 10, $R_1$ is independently selected from a hydrogen atom and alkyl groups having 1 to 8 carbon atoms, and each $R_2$ is independently selected from a hydrogen atom and alkyl groups having 1 to 3 carbon atoms.

A first object of the present invention is to provide a high-performance traction fluid having a high traction coefficient. A second object of the present invention is to provide a traction fluid which is not only economical but also readily available and easily applicable to transmissions.

The traction fluid of the present invention comprises a diester or its derivative in which two cyclohexyl rings are connected to each other through a straight-chain or branched hydrocarbon and which has the above-mentioned structural formula. A' of the ester linkage is —COO— or —OOC—, and the number, n, of the carbon atoms in the hydrocarbon skeleton is 1 to 10, preferably 1 to 4. When n is zero, the traction coefficient is low while when n is 11 or more the viscosity is unfavorably high. This diester or derivative thereof has a viscosity of 5 to 50 cst, preferably 7 to 30 cst at 40° C., and 1 to 10 cst, preferably 2 to 6 cst, at 100° C.

The diester can be prepared by any of the following methods. The first method comprises an esterification reaction of a dihydric alcohol with a cyclohexanecarboxylic acid compound. The dihydric alcohol to be used has 1 to 10 carbon atoms, preferably 1 to 4 carbon atoms. Specifically, examples of the dihydric alcohol include ethylene glycol, 1,3-propanediol, 1,3-butanediol and 1,4-butanediol. Examples of the cyclohexanecarboxylic acid compound include, besides cyclohexnecarboxylic acid, those having an alkyl group with 1 to 8 carbon atoms, e.g., methylcyclohexanecarboxylic acid, ethylcyclohexanecarboxylic acid, etc. Cyclohexanecarboxylic acid is particularly preferred. The esterification reaction is conducted with an alcohol/acid molar ratio of 1:2 or in the presence of an excess amount of the acid. The former method requires the use of a catalyst and has the additional disadvantage that a monoalcohol is produced as the by-product. Therefore, it is preferred that the esterification reaction be conducted in the presence of an excess amount of the acid. Specifically, 1 mol of the dihydric alcohol is reacted with the acid in 2 to 5-fold mol excess (particularly preferred is a 2.5 to 4-fold mol excess). The reaction temperature is about 150° to 250° C., preferably 170 ° to 230° C., and the reaction time is 10 to 40 hr, preferably 15 to 25 hr. Although the esterification reaction may be conducted under either elevated or reduced pressures, it is preferred that the reaction is conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds water, which which has been formed during the reaction, evaporates. The reaction is terminated when the amount of water reaches, twice by mole that of the alcohol. The excess acid is neutralized with an aqueous alkaline solution and removed by washing with water. When an acid which is difficult to extract with an alkali washing is used the reaction is conducted using the acid in an amount of2 to 2.5-fold mol excess over the alcohol in the presence of a catalyst. Examples of the catalyst include phosphoric acid, p-toluenesulfonic acid and sulfuric acid. The most preferable catalyst is phosphoric acid because it enhances the reaction rate and increases the yield of the ester. The reaction product is finally distilled under reduced pressure to remove water and the solvent thereby obtaining the diester compound of the present invention.

The second method of producing the diester comprises esterification of a cyclohexanol compound with a the cyclohexanol compound include, besides cyclohexanol, those having an alkyl group with 1 to 8 carbon atoms, e.g., methylcyclohexanol and tertbutylcyclohexanol. Cyclohexanol is particularly preferred. The dicarboxylic acid includes one having 3 to 12 carbon atoms in its main chain, preferably one having 3 to 6 carbon atoms in its main chain. Examples of the dicarboxylic acid include malonic acid, succinic acid and glutaric acid. The esterification reaction is conducted in an alcohol/acid molar ratio of 2:1 or in the presence of an excess amount of the alcohol. In the former method there is a possibility of forming a monocarboxylic acid as the by-product. Therefore, it is preferred that the esterification reaction is conducted in the presence of an excess amount of the alcohol. Specifically, 1 mol of the dicarboxylic acid is reacted with the alcohol in 2.5 to 5-fold mol excess. The reaction temperature is about 150° to 250° C., preferably 170 to 230° C., and the reaction time is 10 to 40 hr, preferably 15 to 25 hr. Although the esterification reaction may be conducted under either elevated or reduced pressures it is preferred that the reaction be conducted at atmospheric pressure from the standpoint of ease of reaction operation. An alkylbenzene such as xylene or toluene can be added in a suitable amount as a solvent. The addition of the solvent enables the reaction temperature to be easily controlled. As the reaction proceeds the water which has been formed hen the amount of the water reaches twice by mol that of the alcohol. Phosphoric acid, p-toluenesulfonic acid or sulfuric acid can be used as a catalyst. The most preferable catalyst is phosphoric acid because it enhances the reaction rate and increases the yield of the ester. The reaction product is finally distilled under reduced pressure to remove the water, solvent and excess alcohol thereby obtaining the diester compound of the present invention.

The diester of the present invention, e.g., a diester of succinic acid with cyclohexanol, exhibits a traction coefficient of 0.102 to 0.106. Therefore, even when the diester is used alone in a traction drive device it exhibits high performance. Further, a second component may be added to the diester. The second component is a compound which not only improves the traction coefficient through a synergistic effect with the cyclohexyl rings but also is inexpensive and has excellent viscosity characteristics. The addition of such a second component to the diester enables economically advantageous production of a traction fluid. The amount of the second component added is usually 0.01 to 90% by weight, particularly preferably 0.1 to 70% by weight.

Various additives may also be added to the traction fluid of the present invention according to its intended applications. Specifically, when the traction device undergoes a high temperature and a large load, at least one additive selected from among an antioxidant, a wear inhibitor and a corrosion inhibitor may be added in an amount of 0.01 to 5% by weight. Similarly, when a high viscosity index is required, a known viscosity index improver is added in an amount of 1 to 10% by weight.

The term "traction fluid" as used in the present invention is intended to mean a fluid for use in devices which transmit a rotational torque through point contact or line contact, or for use in transmissions having a similar structure. The traction fluid of the present invention exhibits a traction coefficient higher than those of conventionally known fluids, i.e., exhibits a traction coefficient 5 to 15% higher than those of the conventional fluids, although the value varies depending on the viscosity. Therefore, the traction fluid of the present invention can be advantageously used for relatively low power drive transmissions including internal combustion engines of small passenger cars, spinning machines and food producing machines, as well as large power drive transmissions such as industrial machines etc.

The traction fluid of the present invention exhibits remarkably superior traction coefficient compared to conventional fluids. The reason why the traction fluid of the present invention exhibits a high traction coefficient is not yet fully understood. However, basically, the reason is believed to reside in the unique molecular structure of the traction fluid of the present invention.

The traction fluid of the present invention comprises a diester. The diester has two cyclohexyl rings in its molecule. The two ester linkages bring about an interdipolar force between the molecules. It is believed that the interdipolar force serves to bring the fluid into a stable glassy state under high load conditions, thereby increasing the shearing force. Further, the traction fluid of the present invention possesses a structure having a suitable flexibility, because the carbon atoms in the basic skeleton are connected to the two cyclohexyl rings through an ester linkage. Therefore, when the traction device is under high load conditions the cyclohexyl rings are firmly engaged, like gears, with the linked portions of the linear-chain hydrocarbons, while when the device is released from the load this engagement is quickly detached thereby causing fluidization.

The following examples are provided for illustrative purposes only and are not to be construed as limiting the invention herein described.

EXAMPLES 1 TO 4

Dicyclohexyl diester $A_1$ of the present invention was synthesized by the following method.

First, 118 g of succinic acid and 250 g (i.e., 2.5 mol per mol of succinic acid) of cyclohexanol were charged into a reactor, and phosphoric acid was added in an amount of 1 % by weight based on the total weight the reactants.

The reactor was heated at 180° C. The contents of the reactor were allowed to react at a temperature in the range of 180° C. to 210° C. under atmospheric pressure. The reaction was stopped at a point when the water generated during the reaction amounted to twice by mol the amount of the succinic acid. The reaction mixture was washed with an alkaline solution to remove unreacted compounds, i.e., cyclohexanol and phosphoric acid, from the mixture of the reaction product, i.e., an ester of cyclohexanol with succinic acid, the unreacted compounds and phosphoric acid, followed by vacuum distillation, thereby isolating a pure diester ($A_1$).

In the same method as mentioned above, diesters ($A_2$ to $A_4$) of the present invention were synthesized using the following raw materials:

$A_2$ . . . cyclohexanol and malonic acid $A_3$ . . . ethylene glycol and cyclohexanecarboxylic acid (in excess acid)

$A_4$ . . . 1,3-butanediol and cyclohexanecarboxylic acid (in excess acid)

The traction coefficient of each of the diesters was measured. The conditions of measurement of the traction coefficient were as follows:

measuring equipment: Soda-type four-roller traction testing machine test conditions: a fluid temperature of 20° C.; a roller temperature of 30° C.; a mean Hertzian pressure of 1.2 GPa; a rolling velocity of 3.6 m/s: and a slipping ratio of 3.0%.

The traction fluid of the present invention was found to be remarkably superior in traction performance to the conventional fluids as shown in Table 1.

COMPARATIVE EXAMPLES 1 TO 4

A commercially available traction fluid B (Santotrack® manufactured by the Monsanto Chemical Company), polybutene C (having an average molecular weight of 900), a commercially available napthenic compound D (having 1 to 3 cyclohexyl rings), and dicyclohexyl fumarate E were used as comparative samples. The traction coefficient of each comparative sample was measured in the same manner as described hereinafore.

The results are shown in Table 1. As can be seen from Table 1, all the comparative samples exhibited traction coefficients 10 to 15% smaller than that of the diester compound of the present invention.

TABLE 1

| | Traction base oil component | Kinematic viscosity at 40° C. (cst) | Kinematic viscosity at 100° C. (cst) | Viscosity index | Traction coefficient |
|---|---|---|---|---|---|
| Example | | | | | |
| 1 | diester of the present invention $A_1$ | 23.5 | 3.86 | 4.9 | 0.104 |
| 2 | diester of the present invention $A_2$ | 7.40 | 2.05 | 55.0 | 0.102 |
| 3 | diester of the present invention $A_3$ | 12.2 | 2.97 | 93.0 | 0.091 |
| 4 | diester of the present invention $A_4$ | 13.8 | 3.2 | 92.2 | 0.094 |
| Comp. Ex. | | | | | |
| 1 | "Santotrack® B | 13.84 | 2.99 | 46 | 0.087 |
| 2 | Polybutene C | 11600 | 240 | 108 | 0.081 |
| 3 | Commercially available fluid D | 8.6 | 2.1 | 25 | 0.086 |
| 4 | Dicyclohexyl fumarate E | — | — | — | (impossible to measure due to too high a viscosity) |

The traction fluid of the present invention comprises a diester of which the skeleton comprises two cyclohexyl rings and linear chain hydrocarbons and not only exhibits an extremely high traction coefficient but also is inexpensive and exhibits excellent viscosity characteristics.

Therefore, the use of the traction fluid of the present invention in a power transmission device, particularly a traction drive device, leads to a remarkable increase in shearing force under a high load, which enables the reduction in size of the device and economical supply of the device.

What is claimed is:

1. A traction fluid comprising a major amount of diester or its derivative represented by the general formula

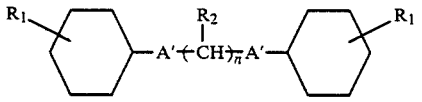

wherein A′ is an ester linkage of —COO— or —OOC—, n is an integer of from 1 to 10, $R_1$ is independently selected from the group consisting of hydrogen and alkyl groups having 1 to 8 carbon atoms, and $R_2$ is independently selected from the group consisting of hydrogen and alkyl groups having 1 to 3 carbon atoms; and a minor amount of at least one material selected from the group consisting of antioxidants, wear inhibitors, corrosion inhibitors and viscosity index improvers.

2. A traction fluid of claim 1 wherein $R_1$ is independently selected from the group consisting of hydrogen and alkyl groups having 1 to 4 carbon atoms.

3. A traction fluid composition of claim 1 wherein n is an integer of 1 to 4.

4. A traction fluid of claim 1, wherein $R_2$ is independently selected from the group consisting of hydrogen or methyl group.

5. A traction fluid composition of claim 4 wherein $R_2$ is hydrogen.

6. A traction fluid composition of claim 3 wherein $R_2$ is hydrogen.

7. A traction fluid composition of claim 1 wherein $R_1$ is hydrogen.

8. A traction fluid composition comprising a major amount of base oil comprised of at least one diester or its derivative represented by the formula

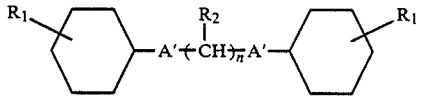

wherein A′ is an ester linkage of —COO— or —OOC—, n is an integer of from 1 to 10, $R_1$ is independently selected from the group consisting of hydrogen and alkyl radicals having from 1 to 8 carbons, and $R_2$ is independently selected from the group consisting of hydrogen and alkyl radicals containing from 1 to 3 carbon atoms; and a minor amount of at least one material selected from the group consisting of antioxidants, wear inhibitors, corrosion inhibitors and viscosity index improvers.

9. A traction fluid composition of claim 8 wherein $R_2$ is hydrogen.

10. A traction fluid composition of claim 8 wherein $R_1$ is hydrogen.

* * * * *